US006219959B1

(12) United States Patent
Hsieh

(10) Patent No.: US 6,219,959 B1
(45) Date of Patent: Apr. 24, 2001

(54) NET TRAPPING SYSTEM FOR CAPTURING A ROBBER IMMEDIATELY

(76) Inventor: Kuo Cheng Hsieh, 5F, No. 241 Changan Road Sec. 2, Taichung (TW)

( * ) Notice: Subject to any disclaimer, the term of this patent is extended or adjusted under 35 U.S.C. 154(b) by 0 days.

(21) Appl. No.: 09/434,570

(22) Filed: Nov. 4, 1999

(51) Int. Cl.[7] ..... E05G 5/02
(52) U.S. Cl. ..... 43/59; 109/3
(58) Field of Search ..... 43/59; 109/2, 3

(56) References Cited

U.S. PATENT DOCUMENTS

| | | | | |
|---|---|---|---|---|
| 767,346 | * | 8/1904 | Kaiser | 43/59 |
| 1,142,736 | * | 6/1915 | Smakel | 109/2 |
| 1,378,378 | * | 5/1921 | Petterson | 43/59 |
| 1,428,003 | * | 9/1922 | Chambers | 109/3 |
| 1,584,195 | * | 5/1926 | Schmaus | 43/59 |
| 3,965,827 | * | 6/1976 | Reeves | 109/3 |
| 4,947,764 | * | 8/1990 | Rohr | 109/3 |

FOREIGN PATENT DOCUMENTS

| | | | |
|---|---|---|---|
| 2735128 | * | 2/1979 | (DE) . |
| 3500566 | * | 7/1985 | (DE) . |
| 1-255095 | * | 10/1989 | (JP) . |
| 4-293881 | * | 10/1992 | (JP) . |
| 7-54544 | * | 2/1995 | (JP) . |
| WO 97/23852 | * | 7/1997 | (WO) . |

* cited by examiner

*Primary Examiner*—Darren W. Ark
(74) *Attorney, Agent, or Firm*—Pro-Techtor International Services

(57) ABSTRACT

A net trapping system for capturing a robber immediately is used in a place of business such as a bank. The device looks like a storing box and is installed above the entrance of the business. When a robbery takes place and the system is activated, an infrared detecting device determines if a robber is in a zone beneath the storing box. A net, a curtain, and a plurality of barriers will drop down immediately and simultaneously. After a lifting motor is activated, the system traps the robber and suspends him above the floor.

4 Claims, 9 Drawing Sheets

NET TRAPPING SYSTEM FOR CAPTURING A ROBBER IMMEDIATELY

BACKGROUND OF INVENTION

1. Field of the Invention

The present invention relates to a net trapping system for capturing a robber immediately. It can effectively protect the lives and property of a business owner and employees.

2. Description of the Prior Art

Because of economic conditions, many crimes occur, especially robberies. Recent robbery cases are more direct and the weapons used are more advanced than before. Such behavior makes policemen or security personnel somewhat apprehensive of capturing the robbery in the act. in addition, it is predictable how scared a weaponless clerk or employee will be.

Due to the mass media (such as TV news), more and more persons learn how to rob stores or banks. This increases the possibility for robberies. However, at this time, except increasing the policeman patrol and hiring more security personnel, it seems that there is no effective way to stop the trend. Further, because robberies are becoming more advanced and professional, if we cannot capture the robber immediately, it is very hard to ever capture him.

SUMMARY OF THE INVENTION

The main purpose of the present invention is to provide a net trapping system for capturing a robber immediately. Without directly confronting a robber, it can effectively and quickly capture the robber so as to protect the lives and property of the business owner and employees.

DETAILED DESCRIPTION OF THE PREFERRED EMBODIMENT

Figure 1:
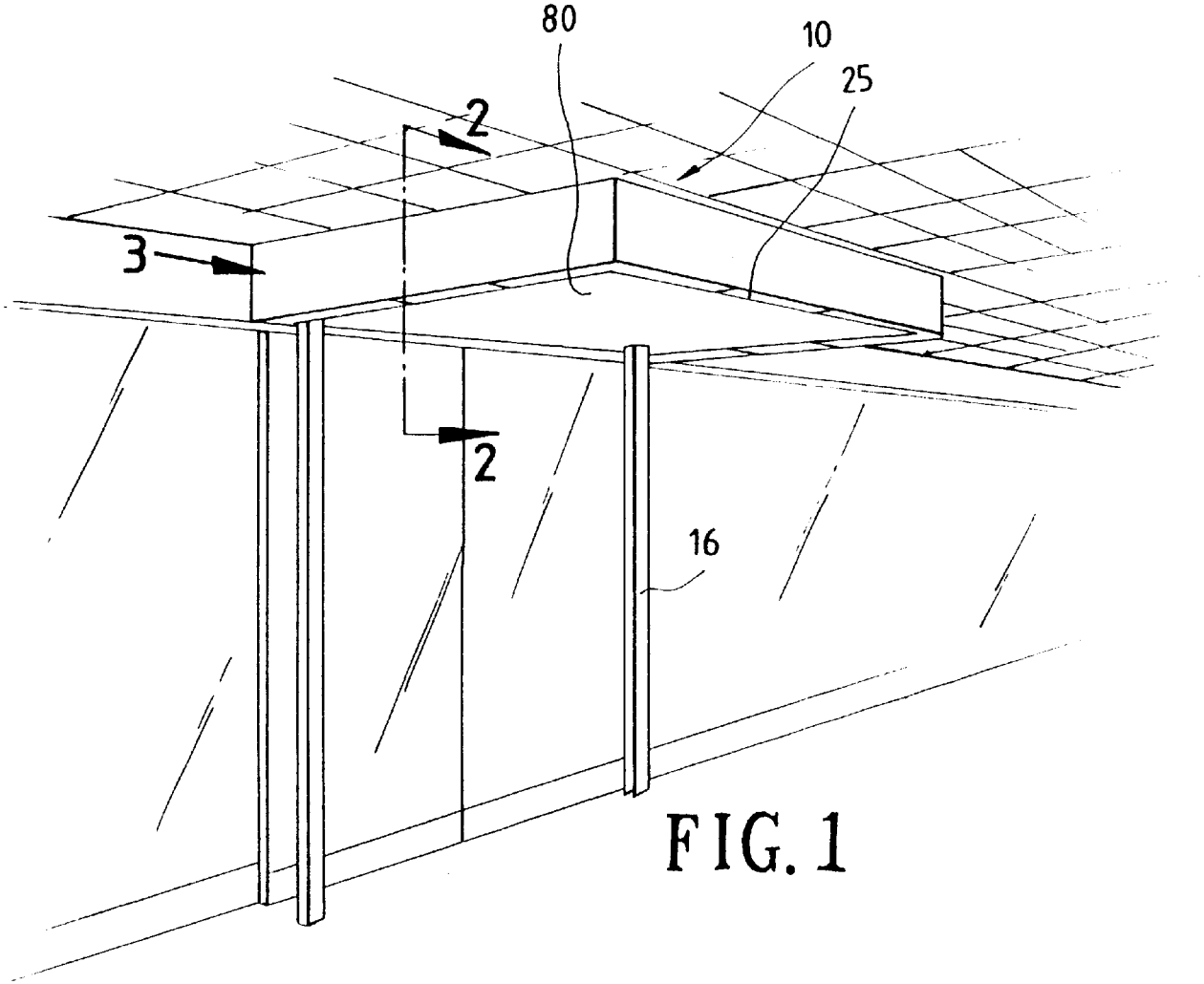
FIG. 1 is a perspective view of the present invention.
Figure 2:
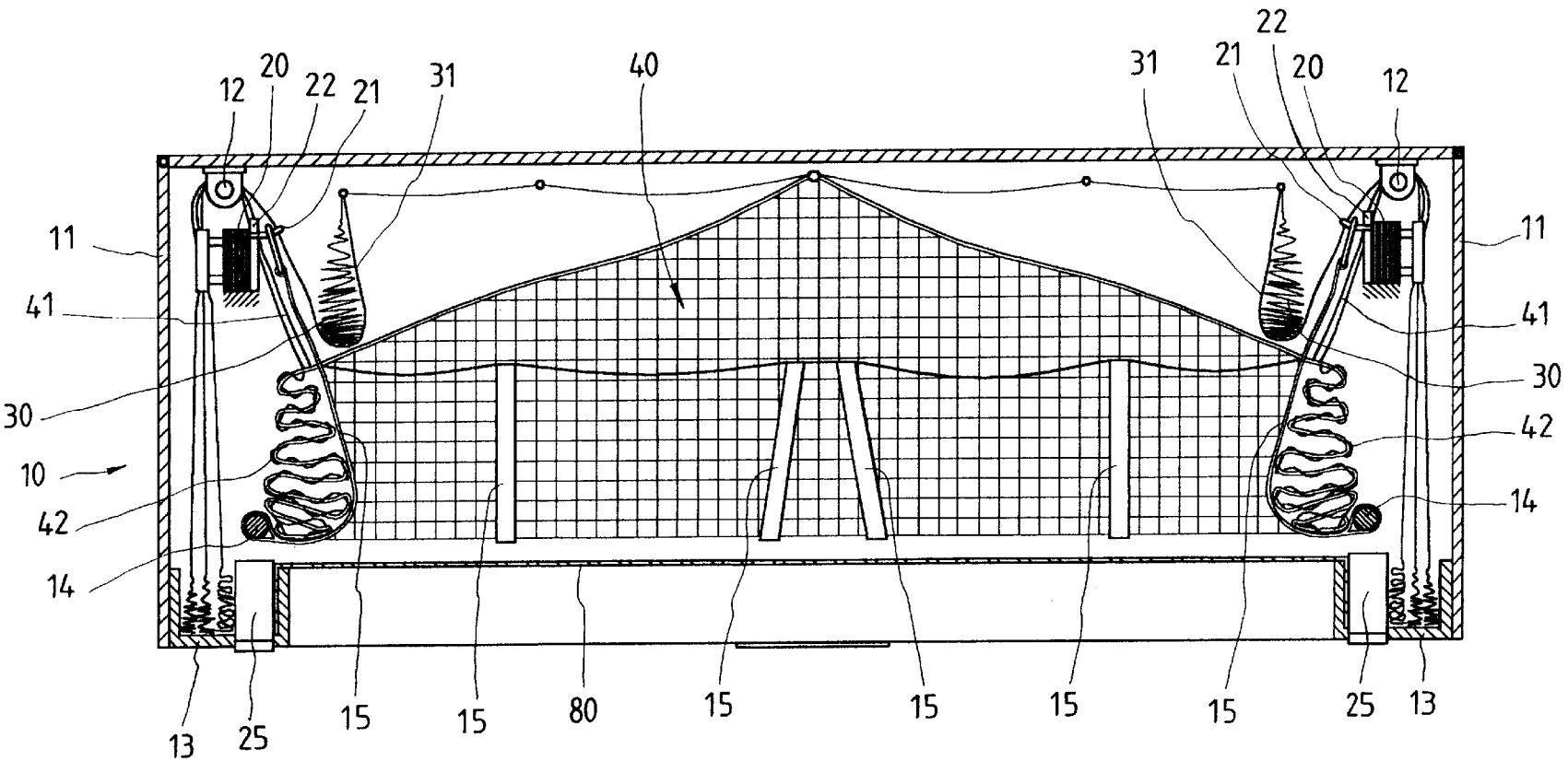
FIG. 2 is a cross-sectional view of the present invention in an assembled state.
Figure 3:
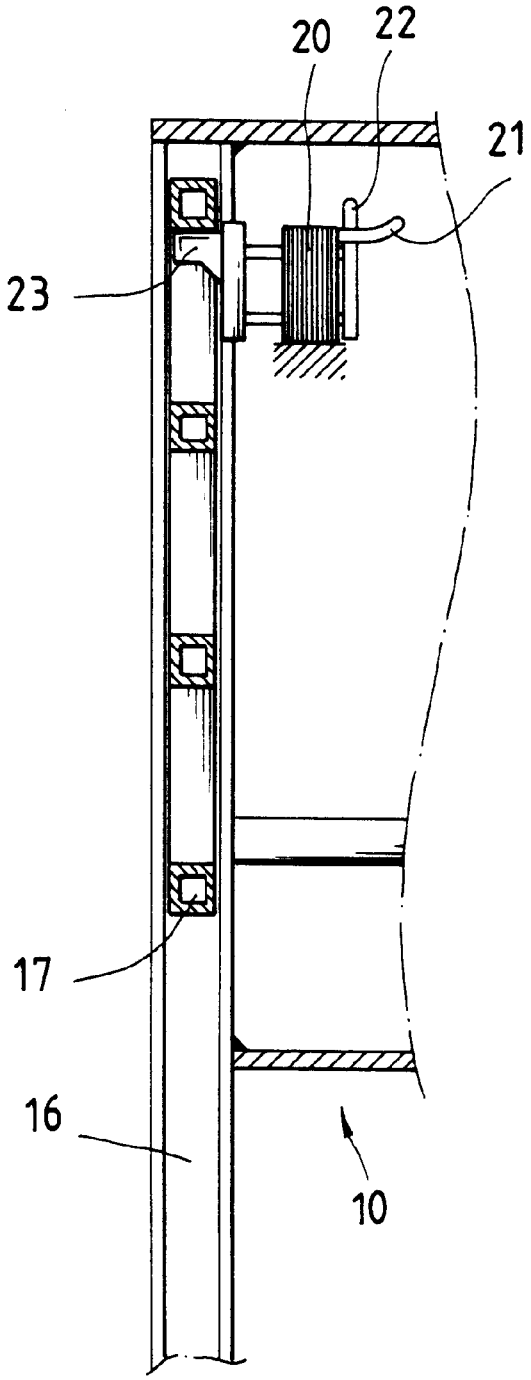
FIG. 3 is cross-sectional view showing the barriers.
Figure 4:
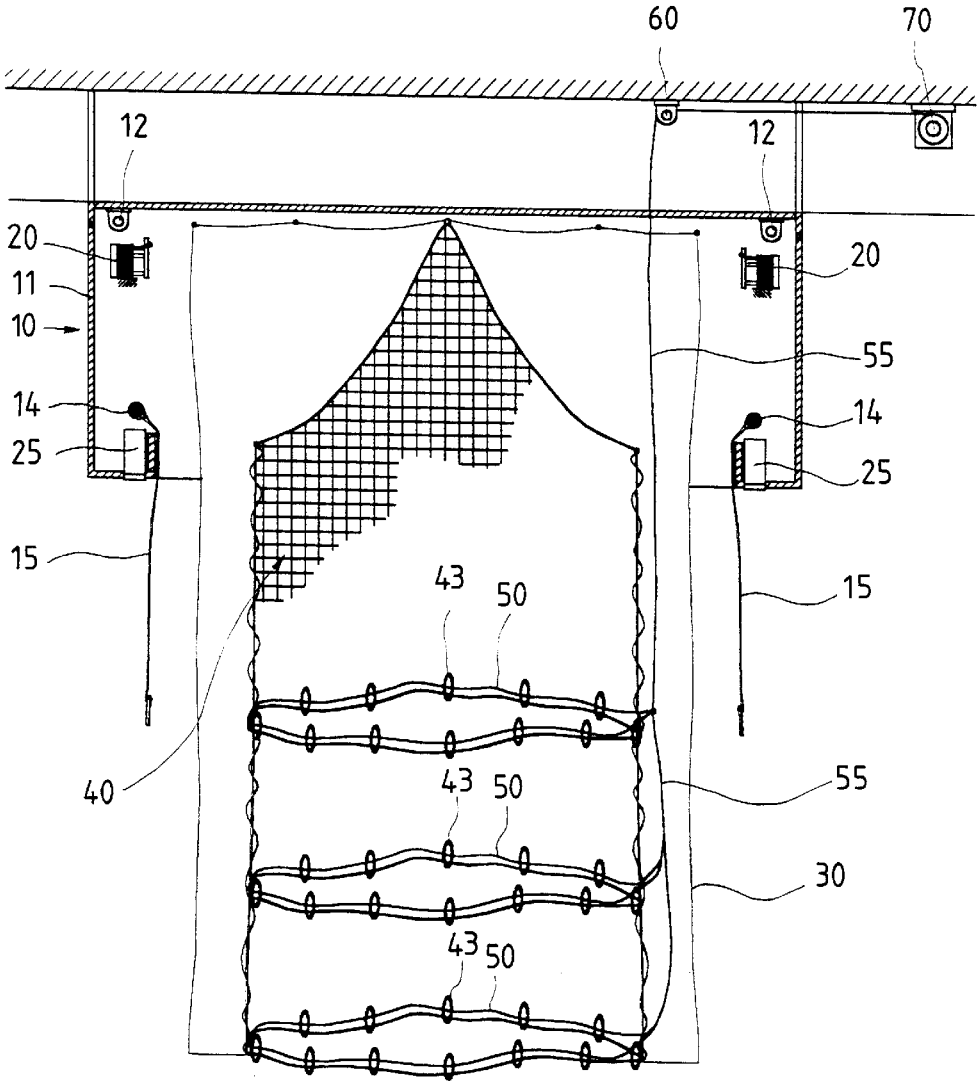
FIG. 4 shows the present invention when the curtain is dropped.

Referring first to FIGS. 1–3, the present invention is a net trapping system for capturing a robber immediately. It is installed above the entrance of a business. It mainly comprises the following:

A storing box (10) is disposed on a ceiling near the entrance of a place of business, (such as a bank or a store). The storing box (10) has a main frame and a plurality of openable side plates (11). A plurality of pulleys (12) are disposed on the main frame. A U-shaped slot frame (13) is disposed on a bottom of each side plate (11). A positioning rod (14) is disposed above each U-shaped slot frame (13). A plurality of positioning ropes (15) are disposed on these positioning rods (14). Two vertical and parallel sliding slots (16) are disposed near the entrance for receiving barriers (17).

A plurality of electromagnetic controllers (20) are disposed between the positioning rods (14) and the pulleys (12). At least one infrared detecting device (25) is disposed on said U-shaped slot frame (13). A hanging rod (21) and a pushing rod (22) are disposed on one side of each electromagnetic controller (20). A stopping block (23) protrudes form the other side of the electromagnetic controller (20).

A curtain (30) is stored in an upper portion or-the storing box (10). The curtain (30) has an upper edge arid a lower edge. The upper edge is fixed on the storing box (10). The lower edge is connected with a curtain pulling rope (31) extending outward and then upward around the pulleys (12).

A bell-shaped net (40) is formed inside the curtain (30). The net (40) has a top point which connects to an upper pulling rope (41). The net (40) has a bottom edge which connects to a plurality of lower pulling ropes (42). The lower pulling ropes (42) extend upward and pass through the net (40). Both the upper and lower pulling ropes (41,42) pass around the pulleys (12). At least first, second, and third horizontal levels are disposed on the net (30). Each level has a plurality of steel rings (43). The first level is disposed on the bottom edge of the net (40). The second level is disposed at a predetermined height above the bottom edge of the net (40) approximately equal to a length from a human's foot to knee. The third level is disposed at another predetermined height above the bottom edge approximately equal to a length from a human's foot to waist. Three closing ropes (50) pass through the steel rings (43) and are connected with a main hanging rope (55) and are then connected to a lifting motor (70) via a top pulley (60).

Figure 5:
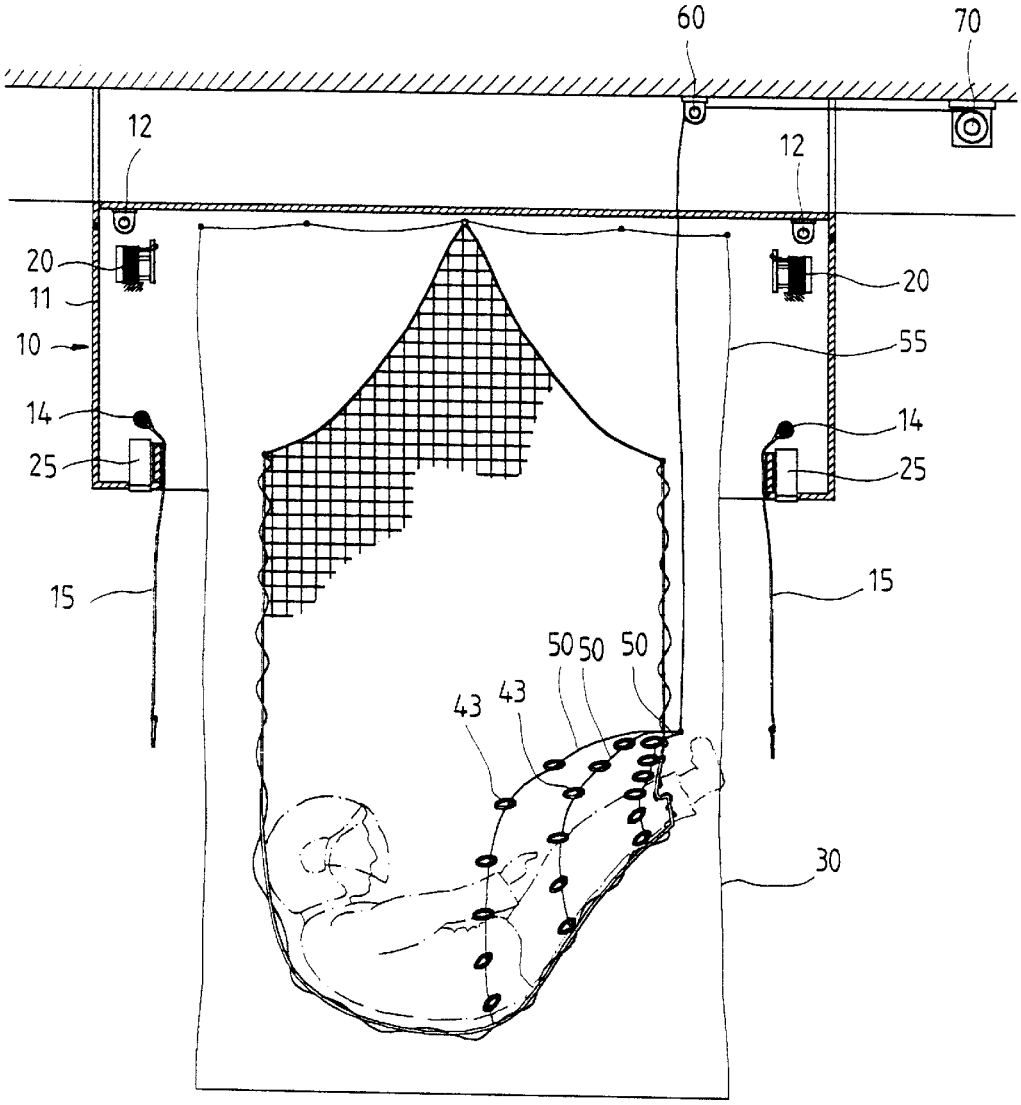
FIG. 5 shows a robber trapped inside the net.
Figure 6:
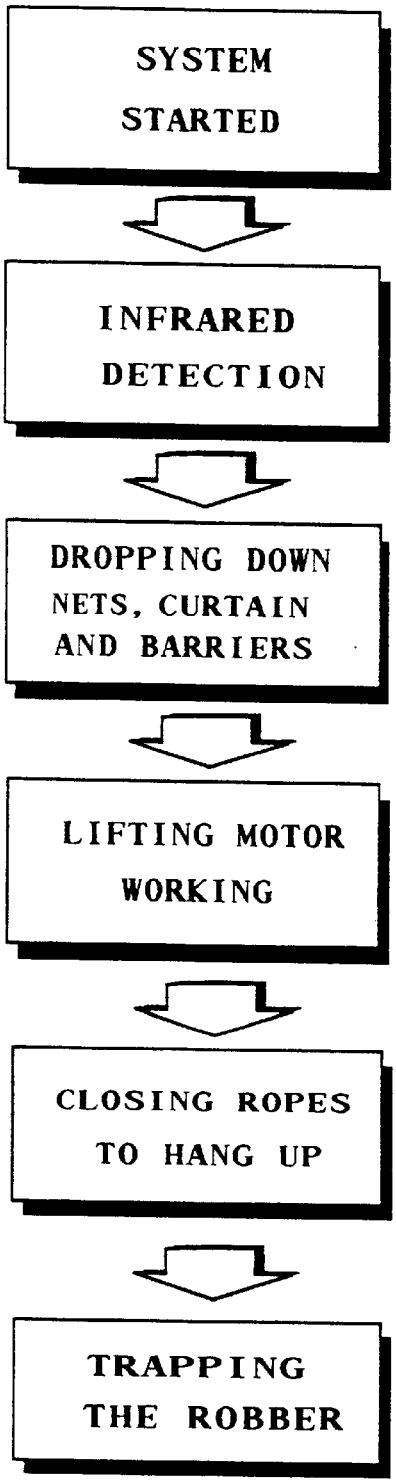
FIG. 6 is a flow chart showing the present invention's steps.

Once the system is started, the infrared detecting devices (25) are activated and the entrance is automatically closed. If a robber moves to a zone beneath the storing box (10), he is detected by the infrared detecting devices (25). The electromagnetic controller (20) makes the pushing rod (22) move so that the positioning rope (15) drops down. Meanwhile, the net (40), steel rings (43), and curtain (30) break a cover plate (80) so that they are all dropped down. Also, due to the movement of stopping block (23), the barriers (17) will fall down. After which, the lifting motor (70) is started to lift the main hanging rope (55) so as to make the closing ropes (50) encircle the robber and hang the robber in an upside down position (shown in FIG. 5).

If the robber runs very quickly and is not trapped by the net (40), the robber still will be hit by the falling barriers (17) so that the robber is disabled hurt and cannot escape quickly.

In addition, the time between the net (40) beginning to drop and the robber being hung about one meter above the floor is approximately one second. The width of the storing box (10) can be adjusted according to the entrance's width, and the size of the net and the curtain can be adjusted too.

Figure 7:
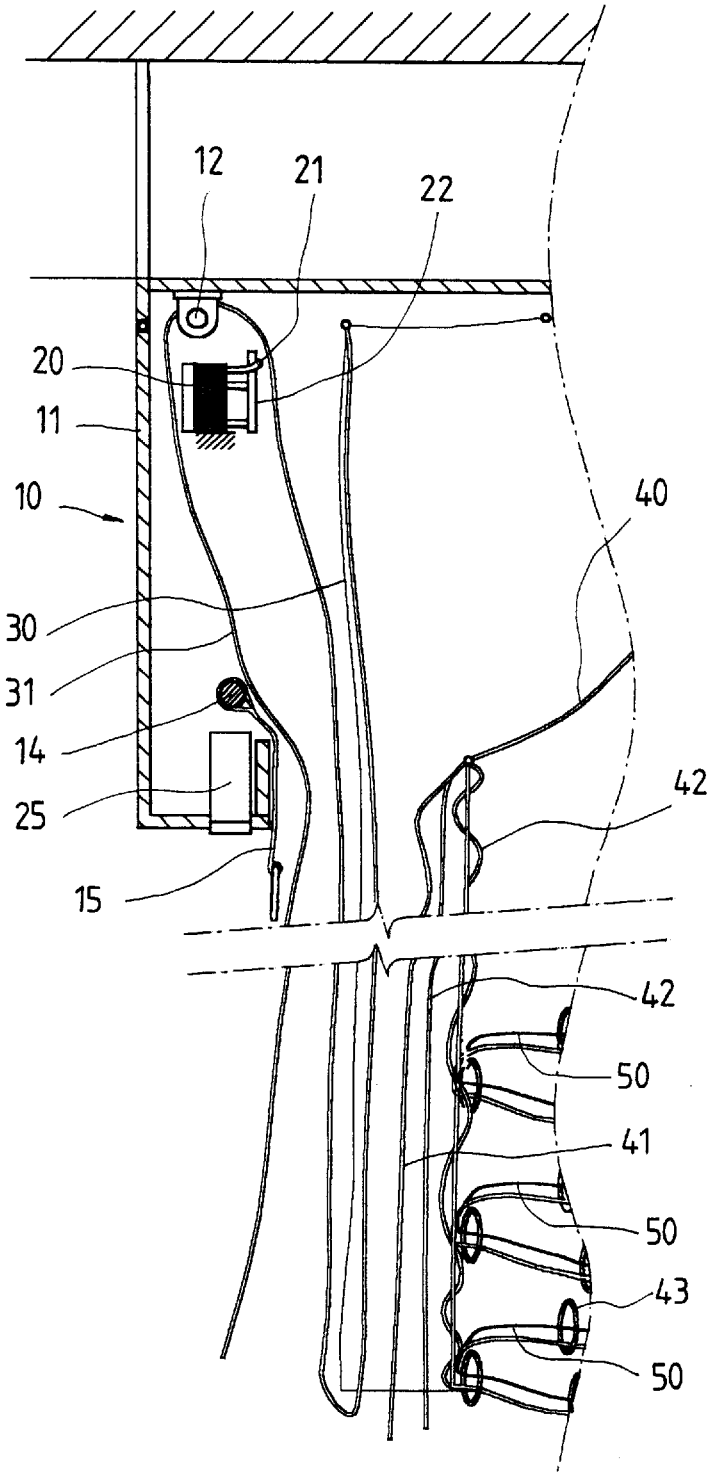
FIG. 7 shows the pulling state of the present invention.
Figure 8:
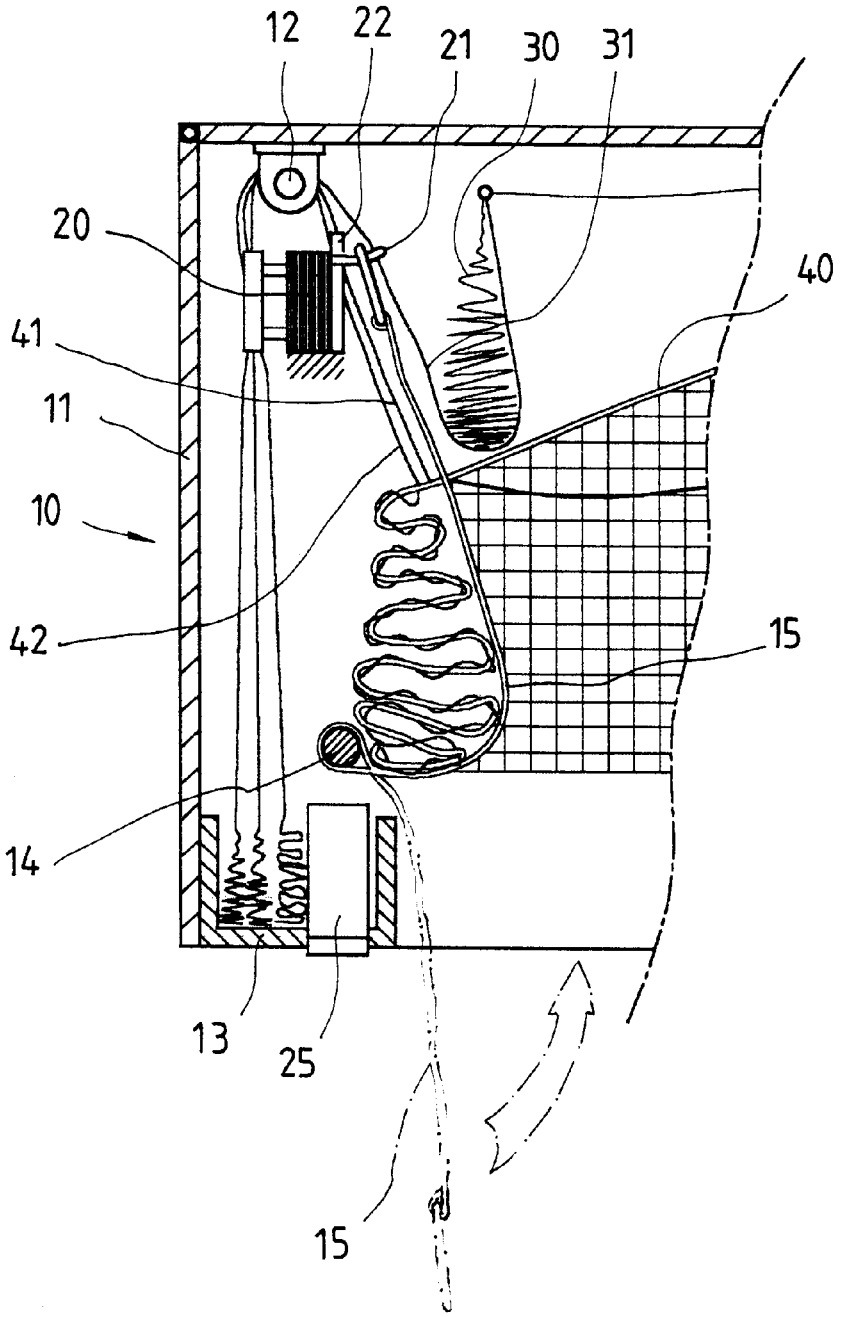
FIG. 8 shows the net and curtain returned to their original positions.
Figure 9:
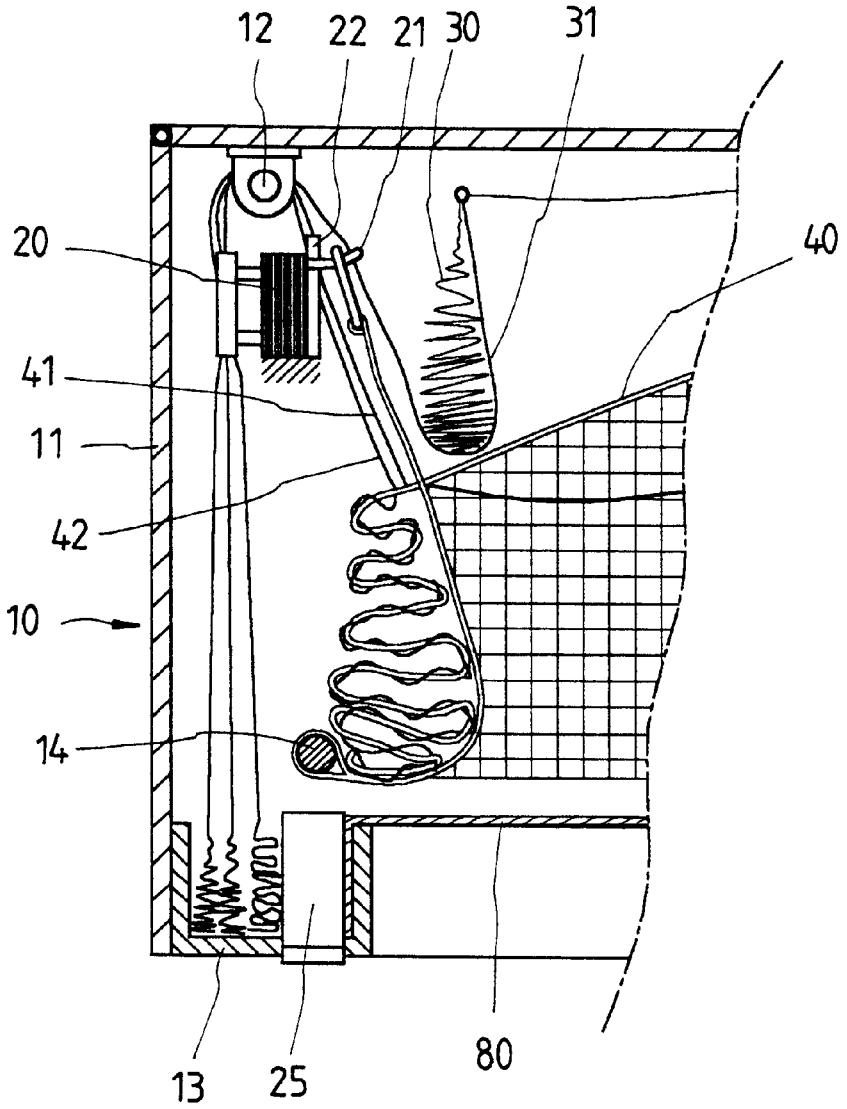
FIG. 9 shows the system in a reset condition.

When a person needs to reset the system to the initial condition (shown in FIGS. 7 and 8), the person should pull up the curtain pulling rope (31), the upper pulling rope (41), and lower pulling ropes (42). The curtain (30) and the net (40) will return to the top position in the storing box (10). The user then tightens the curtain pulling rope (31), the upper pulling rope (41), and the lower pulling ropes (42) on the positioning rod (14). At this time, the positioning rope (15) winds around the bottom of the net (40) and then passes through the net's top to fix the positioning rope (15) on the hanging rod (21) of the electromagnetic rod (21).

The pushing rod (22) of the electromagnetic controller (20) is pushed back. The stopping blocks (23) hold the barriers (17) at their original positions. The curtain (30) is hung by the positioning rope (15) and fixed on the hanging rod (21) so that the curtain (30) is stored between the net's (40) top and the positioning rope (15). Due to the weight of the curtain (30), the positioning rope (15) will be squeezed toward the hanging rod (21) of the electromagnetic controller (20) so as to make the positioning rope (15) not loosen easily. Then the curtain pulling rope (31), the upper pulling rope (41), and the lower pulling ropes (42) are released from the positioning rods (14) and stored in the U-shaped slot frame (13). Finally, a cover plate 80 (which may be made of paper) is placed on the inner edge of the U-shaped slot frame (13) so as to seal the bottom opening of the storing box (10). Therefore, the re-installation is complete.

The above disclosure is not intended as limiting. Those skilled in the art will readily observe that numerous modifications and alterations of the device may be made while retaining the teachings of the invention. Accordingly, the above disclosure should be construed as limited only by the restrictions of the appended claims.

What is claimed is:

1. A net trapping system in combination with a place of business, said combination comprising:

a storing box disposed on a ceiling near an entrance of said place of business, said storing box having a main frame and a plurality of openable side plates, a plurality of pulleys being disposed on said main frame, a U-shaped slot frame being disposed on a bottom of each side plate, a positioning rod being disposed above each U-shaped slot frame, a plurality of positioning ropes being disposed on said positioning rods, two vertical and parallel sliding slots being disposed near said entrance and having barriers;

electromagnetic controllers being disposed between said positioning rods and said pulleys, at least one infra-red detecting device being disposed on at least one of said U-shaped slot frames, a hanging rod and a pushing rod being disposed on a first side of each electromagnetic controller, a stopping block protruding from a second side of each said electromagnetic controller;

a curtain stored in a upper portion of said storing box, said curtain having an upper edge and a lower edge, said upper edge being fixed on said storing box, and said lower edge being connected to a curtain pulling rope extending around said pulleys;

a bell-shaped net formed inside said curtain, said net having a top point which connects to an upper pulling rope, said net having a bottom edge which connects several lower pulling ropes, said lower pulling ropes extending upward and passing through said net, both said upper and said lower pulling ropes passing around said pulleys, at least first, second, and third horizontal levels being disposed on said net, each level having a plurality of steel rings, said first level being disposed on said bottom edge, said second level being disposed above said bottom edge, said third level being disposed above said second level, three closing ropes passing through said steel rings and connected with a main hanging rope and then connected to a lifting motor via a top pulley;

wherein once said system is activated, said at least one infra-red detecting device begins to detect, and said entrance is automatically closed; if a robber is detected in an area under said storing box, each said electromagnetic controller makes each said pushing rod move so that each said positioning rope drops down, and said net, steel rings, curtain and barriers are all dropped down; then said lifting motor is started to lift said main hanging rope so as to make said closing ropes encircle and raise the robber.

2. The net trapping system in combination with a place of business as claimed in claim 1, wherein:

if the robber is not trapped by said net, the robber is hit by said barriers falling from a stored position so that the robber is disabled.

3. The net trapping system in combination with a place of business as claimed in claim 1, wherein:

a time between said net beginning to drop and the robber being raised about one meter is approximately one second.

4. The net trapping system in combination with a place of business as claimed in claim 1, wherein:

sizes of said storing box said net, and said curtain can be adjusted.

* * * * *